US010881174B2

(12) United States Patent
Wang

(10) Patent No.: US 10,881,174 B2
(45) Date of Patent: Jan. 5, 2021

(54) ILLUMINABLE SUN UMBRELLA

(71) Applicant: Linhaishi Hanfeng Leisure Products Co., Ltd., Linhai (CN)

(72) Inventor: Ziguo Wang, Linhai (CN)

(73) Assignee: Linhaishi Hanfeng Leisure Products Co., Ltd.

( * ) Notice: Subject to any disclaimer, the term of this patent is extended or adjusted under 35 U.S.C. 154(b) by 0 days.

(21) Appl. No.: 16/360,848

(22) Filed: Mar. 21, 2019

(65) Prior Publication Data

US 2020/0288828 A1 Sep. 17, 2020

(30) Foreign Application Priority Data

Mar. 15, 2019 (CN) ..... 2019 1 0196502

(51) Int. Cl.

| | |
|---|---|
| ***A45B 3/02*** | (2006.01) |
| ***A45B 3/04*** | (2006.01) |
| ***A45B 19/10*** | (2006.01) |
| ***F21S 4/00*** | (2016.01) |
| *F21Y 103/10* | (2016.01) |
| *F21Y 115/10* | (2016.01) |

(52) U.S. Cl.

CPC ..... *A45B 3/04* (2013.01); *A45B 19/10* (2013.01); *F21S 4/00* (2013.01); *A45B 2200/1018* (2013.01); *F21Y 2103/10* (2016.08); *F21Y 2115/10* (2016.08)

(58) Field of Classification Search

CPC ..... F21S 4/00

See application file for complete search history.

(56) References Cited

U.S. PATENT DOCUMENTS

| | | | | |
|---|---|---|---|---|
| 3,885,148 | A * | 5/1975 | Di Benedetto | F21V 23/0414 362/205 |
| 5,879,076 | A * | 3/1999 | Cross | G02B 6/0038 362/555 |
| 6,270,230 | B1 * | 8/2001 | Mai | A45B 3/04 135/910 |
| 7,455,427 | B1 * | 11/2008 | Freeman | E04H 15/10 362/249.16 |
| 2004/0228118 | A1 * | 11/2004 | Peterson | A45B 3/04 362/102 |

* cited by examiner

*Primary Examiner* — William J Carter
*Assistant Examiner* — Omar Rojas Cadima

(57) ABSTRACT

An illuminable sun umbrella comprising a base, a vertical rod, an armrest, a pull rod, an umbrella frame and an umbrella cloth, wherein a plurality of light-transmitting film bags is fixedly arranged on the inner surface of the umbrella cloth, and an LED light strip is inserted into the light-transmitting film bag; the LED light strip is integrally placed into the light-transmitting film bag; the LED light strip is provided with a battery compartment connector, and the battery compartment connector is arranged outside the opening of the light-transmitting film bag; a battery compartment is arranged on the umbrella frame, and is electrically connected with the battery compartment connector; due to the simple circuit connection structure, the illuminable sun umbrella of the present invention can be conveniently installed and maintained.

8 Claims, 2 Drawing Sheets

ILLUMINABLE SUN UMBRELLA

TECHNICAL FIELD OF THE INVENTION

The present invention relates to the technical field of outdoor shading articles, and more particularly, to an illuminable sun umbrella.

BACKGROUND OF THE INVENTION

In the prior art, the traditional illuminable sun umbrellas sold on the market normally have LED light strips installed in the umbrella ribs. Thus, each umbrella rib is provided with a groove, a bayonet and an end cap, resulting in a complex structure, high assembly difficulty and increased manufacturing cost. Once damaged LED light strips are found, it's almost impossible to replace them in time. In such circumstances, dangers can easily occur. In countries with high labor costs, for instance, European and American countries, the difficulty of maintenance brings huge inconvenience to users. Even worse, when an umbrella rib is broken, a circuit failure can be immediately caused, directly affecting the illumination of the umbrella. The poor user experience negatively impacts the manufactures.

SUMMARY OF THE INVENTION

The purpose of the present invention is to solve the shortcomings in the prior art by providing a novel illuminable sun umbrella.

To achieve the above purpose, the present invention adopts the following technical solution:

An illuminable sun umbrella comprising a base, a vertical rod, an armrest, a pull rod, an umbrella frame and an umbrella cloth, wherein a plurality of light-transmitting film bags is fixedly arranged on the inner surface of the umbrella cloth, and an LED light strip is inserted into the light-transmitting film bag; the LED light strip is integrally placed into the light-transmitting film bag; the LED light strip is provided with a battery compartment connector, which is arranged outside the opening of the light-transmitting film bag; a battery compartment is arranged on the umbrella frame, and is electrically connected with the battery compartment connector; the LED light strip inserted into the light-transmitting film bag can be conveniently removed, allowing a user to easily perform the maintenance.

In another aspect of the present invention, the opening of the light-transmitting film bag is overlapped with the edge of the umbrella cloth, and is closured and fixed through a hook-and-loop fastener arranged on the edge of the light-transmitting film bag. The hook-and-loop fastener is a waterproof hook-and-loop fastener, which protects the LED light strips from being damaged in rainy weather, and effectively prolongs the function life of the illuminable sun umbrella.

In another aspect of the present invention, each edge of the umbrella cloth is sewed and fixed with two light-transmitting film bags that are perpendicular to the edge of the umbrella cloth, thus enabling the place under the umbrella to be uniformly illuminated by the light so that the user experience can be greatly improved.

In another aspect of the present invention, there is only one battery compartment, which is fixed on an umbrella rib of the umbrella frame. The battery compartment connector arranged on the LED light strip is electrically connected with the battery compartment through an extended electric wire. All of the extended electric wires can be closured and installed on the edge of the umbrella cloth through the hook-and-loop fastener. In this way, the overall structure of the illuminable sun umbrella of the present invention becomes simple, aesthetically appealing, humanized and cost-effective.

In another aspect of the present invention, a solar umbrella tray is arranged at the apex of the umbrella frame, and is electrically connected with the battery compartment, enabling the umbrella to be more energy-saving, and to be conveniently used in outdoors.

In another aspect of the present invention, a battery box is arranged in the battery compartment, and a storage battery is arranged in the battery box. The storage battery can supply and store power through the solar umbrella tray, thus achieving a long-time illumination at night.

In another aspect of the present invention, the base is a 360-degree rotatable base 11, enabling the illumination of the umbrella to be adjusted at any angle, further achieving a humanized design.

Compared with the prior art, the present invention has the following advantages:

According to the present invention, the light-transmitting film bag can be sewed at any position of the umbrella cloth, and the LED light strip can be installed within the light-transmitting film bag. The plurality of LED light strips sewed with the umbrella cloth can be connected in series through electric wires. The electric wires can be shielded and protected through the hook-and-loop fasteners arranged on the edge of the umbrella cloth. After being connected to the battery compartment arranged on the umbrella rib, the LED light strips are capable of emitting light. Due to the simple circuit connection structure, the illuminable sun umbrella of the present invention can be conveniently installed and maintained. Moreover, a low manufacturing cost, a high product percent of pass, an overall waterproof performance and an ideal illumination effect can be achieved. The low-voltage power supply is safe and reliable. The present invention allows users to easily maintain by unfastening the hook-and-loop fastener, achieving a simple operation and a convenient maintenance.

BRIEF DESCRIPTION OF THE DRAWINGS

To clearly expound the technical solution of the present invention, the drawings and embodiments are hereinafter combined to illustrate the present invention. Obviously, the drawings are merely some embodiments of the present invention and those skilled in the art can associate themselves with other drawings without paying creative labor.

MARKING INSTRUCTIONS OF THE DRAWINGS

Figure 1:
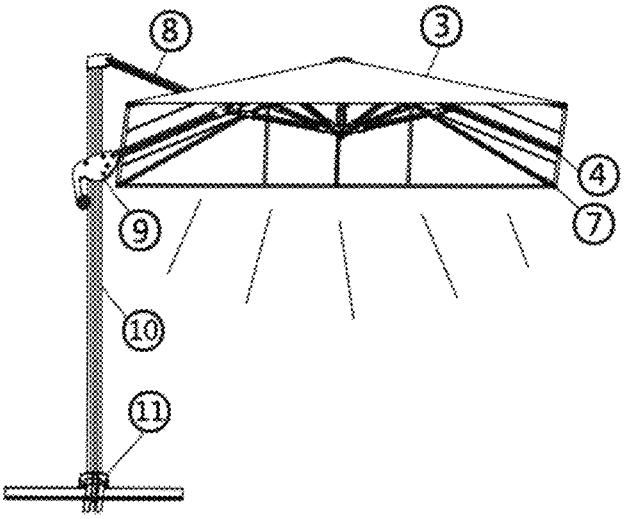
FIG. 1 is an overall structural diagram of the present invention.
Figure 2:
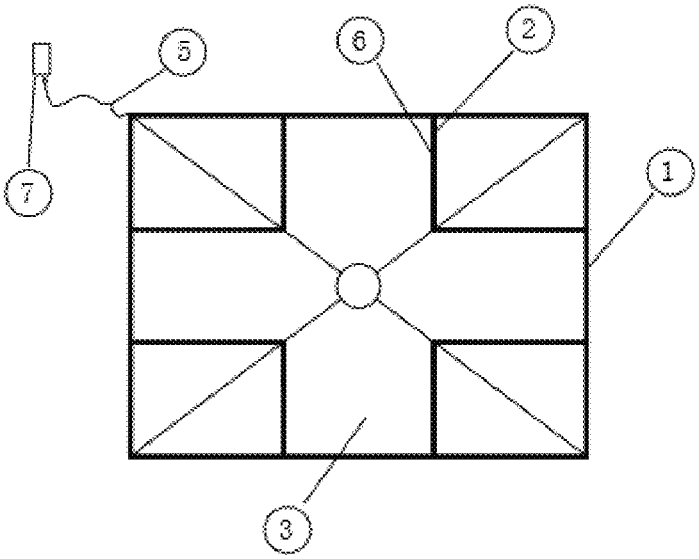
FIG. 2 is a schematic diagram illustrating the inner surface structure of the umbrella cloth of the present invention.
Figure 3:
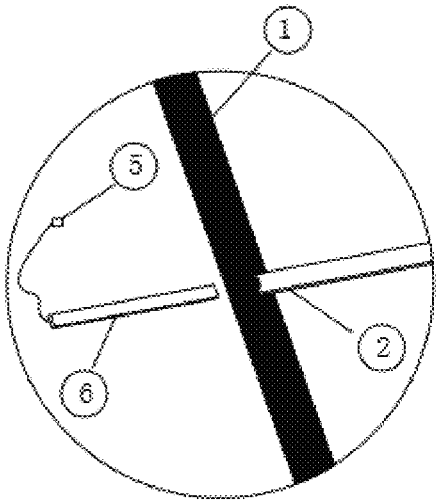
FIG. 3 is a partial enlarged view of FIG. 2 of the present invention.
Figure 4:
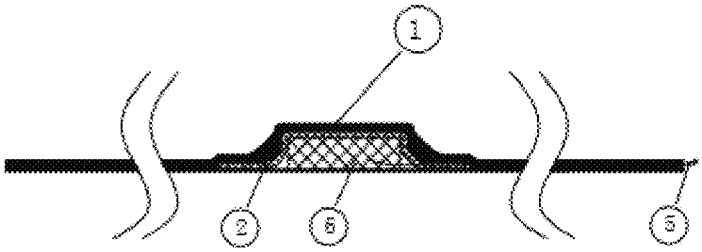
FIG. 4 is a sectional view of the light assembly of the present invention.

Hook-and-Loop Fastener 1, Light-transmitting Film Bag 2, Umbrella Cloth 3, Umbrella Frame 4, Battery Compartment Connector 5, LED Light Strip 6, Battery Compartment 7, Pull Rod 8, Armrest 9, Vertical Rod, Base 11.

DETAILED DESCRIPTION OF THE INVENTION

Drawings and detailed embodiments are combined hereinafter to elaborate the technical principles of the present invention.

The illuminable sun umbrella of the present invention comprises a base 11 used for interacting and assembling with other parts, a vertical rod 10, an armrest 9, a pull rod 8, an umbrella frame 4 and an umbrella cloth 3, wherein a plurality of light-transmitting film bags 2 is fixedly arranged on the inner surface of the umbrella cloth 3, and an LED light strip 6 is inserted into the light-transmitting film bag 2. The LED light strip 6 is integrally placed into the light-transmitting film bag 2. The opening of the light-transmitting film bag 2 is overlapped with the edge of the umbrella cloth 3, and is closured and fixed through a hook-and-loop fastener 1 arranged on the edge of the light-transmitting film bag 2. The hook-and-loop fastener 1 is a waterproof hook-and-loop fastener 1. According to this design, the LED light strips 6 can be protected from being damaged in rainy weather, effectively prolonging the function life of the illuminable sun umbrella. Each edge of the umbrella cloth 3 is sewed and fixed with two light-transmitting film bags 2 that are perpendicular to the edge of the umbrella cloth 3. In this way, the place under the umbrella can be uniformly illuminated by the light emitted by the LED strips, thereby greatly improving the user experience. The LED light strip 6 is provided with a battery compartment connector 5, and the battery compartment connector 5 is arranged outside the opening of the light-transmitting film bag 2. A battery compartment 7 is arranged on the umbrella frame 4, and is electrically connected with the battery compartment connector 5. There is only one battery compartment 7, which is fixed on an umbrella rib of the umbrella frame 4. The battery compartment connector 5 arranged on the LED light strip 6 is electrically connected with the battery compartment 7 through an extended electric wire. All of the extended electric wires can be closured and installed on the edge of the umbrella cloth 3 through the hook-and-loop fastener 1. In this way, the overall structure of the illuminable sun umbrella of the present invention becomes simple, aesthetically appealing, humanized and cost-effective. Moreover, according to the present invention, the LED light strip 6 inserted into the light-transmitting film bag can be conveniently removed, allowing a user to easily perform the maintenance.

A solar umbrella tray is arranged at the apex of the umbrella frame 4, and is electrically connected with the battery compartment 7, thereby enabling the umbrella to become more energy-saving. As a result, the umbrella of the present invention can be conveniently used in outdoors. Furthermore, a battery box is arranged in the battery compartment 7, and a storage battery is arranged in the battery box. The storage battery can supply and store power through the solar umbrella tray, thus achieving a long-time illumination at night. The base 11 is a 360-degree rotatable base 11, enabling the illumination of the umbrella to be adjusted at any angle, further achieving a humanized design.

According to the present invention, the light-transmitting film bag 2 can be sewed at any position of the umbrella cloth, and the LED light strip 6 can be installed within the light-transmitting film bag 2. The plurality of LED light strips 6 sewed with the umbrella cloth can be connected in series through electric wires. The electric wires can be shielded and protected through the hook-and-loop fasteners 1 arranged on the edge of the umbrella cloth. After being connected with the battery compartment 7 arranged on the umbrella rib, the LED light strips 6 are capable of emitting light. Due to the simple circuit connection structure, the illuminable sun umbrella of the present invention can be conveniently installed and maintained. Moreover, a low manufacturing cost, a high product percent of pass, an overall waterproof performance and an ideal illumination effect can be achieved. The low-voltage power supply is safe and reliable. The present invention allows users to easily maintain by unfastening the hook-and-loop fastener 1, achieving a simple operation and a convenient maintenance.

The description of above embodiments allows those skilled in the art to realize or use the present invention. Without departing from the spirit and essence of the present invention, those skilled in the art can combine, change or modify correspondingly according to the present invention. Therefore, the protective range of the present invention should not be limited to the embodiments above but conform to the widest protective range which is consistent with the principles and innovative characteristics of the present invention. Although some special terms are used in the description of the present invention, the scope of the invention should not necessarily be limited by this description. The scope of the present invention is defined by the claims.

The invention claimed is:

1. An illuminable sun umbrella, comprising:

a base, a vertical rod, an armrest, a pull rod, an umbrella frame, and a rectangularly-shaped umbrella cloth, wherein a plurality of elongated light-transmitting film bags is fixedly arranged on the inner surface of the umbrella cloth, wherein at least two of the light-transmitting film bags form a 90-degree angle with each other, wherein each light-transmitting film bag form a 90-degree angle with an edge of the umbrella cloth, wherein an opening of each light transmitting film bag overlaps with the edge of umbrella cloth, wherein the opening of each light transmitting film bag further comprising a hook-and-loop fastener, and an LED light strip is inserted into the light-transmitting film bag through the opening of each light transmitting film bag, wherein the LED light strip is integrally placed into the light-transmitting film bag, wherein a battery compartment connector is arranged outside the opening of the light-transmitting film bag, wherein a battery compartment is arranged on the umbrella frame, and is electrically connected with the battery compartment connector, wherein the plurality of LED light strips are connected in series through electric wires, wherein the electric wires are shielded and protected through hook-and-loop fasteners arranged on the edge of the umbrella cloth.

2. The illuminable sun umbrella of claim 1, wherein the hook-and-loop fastener is a waterproof hook-and-loop fastener.

3. The illuminable sun umbrella of claim 1, wherein there is only one battery compartment, which is fixed on an umbrella rib of the umbrella frame, wherein the battery compartment connector arranged on the LED light strip is electrically connected with the battery compartment through an extended electric wire.

4. The illuminable sun umbrella of claim 3, wherein a battery box is arranged in the battery compartment, and a storage battery is arranged in the battery box.

5. The illuminable sun umbrella of claim 1, wherein a solar umbrella tray is arranged at the apex of the umbrella frame, and is electrically connected with the battery compartment.

6. The illuminable sun umbrella of claim 5, wherein a battery box is arranged in the battery compartment, and a storage battery is arranged in the battery box.

7. The illuminable sun umbrella of claim 1, wherein a battery box is arranged in the battery compartment, and a storage battery is arranged in the battery box.

8. The illuminable sun umbrella of claim 1, wherein the base is a 360-degree rotatable base.

* * * * *